United States Patent [19]

Butt

[11] Patent Number: 4,903,477

[45] Date of Patent: Feb. 27, 1990

[54] GAS TURBINE COMBUSTOR TRANSITION DUCT FORCED CONVECTION COOLING

[75] Inventor: Graham P. Butt, Ancaster, Canada

[73] Assignee: Westinghouse Electric Corp., Pittsburgh, Pa.

[21] Appl. No.: 296,353

[22] Filed: Jan. 10, 1989

Related U.S. Application Data

[63] Continuation of Ser. No. 117,980, Nov. 9, 1987, abandoned.

[30] Foreign Application Priority Data

Apr. 1, 1987 [CA] Canada ..... 553623

[51] Int. Cl.[4] ..... F02C 3/00

[52] U.S. Cl. ..... 60/39.37; 60/760

[58] Field of Search ..... 60/39.37, 39.36, 760, 60/757, 755, 758, 759, 754, 751, 39.83

[56] References Cited

U.S. PATENT DOCUMENTS

| | | | |
|---|---|---|---|
| 3,652,181 | 3/1972 | Wilhelm, Jr. | 60/748 |
| 4,297,843 | 11/1981 | Sato et al. | 60/39.37 |
| 4,339,925 | 7/1982 | Eggmann et al. | 60/760 |
| 4,695,247 | 9/1987 | Enzaki et al. | 60/757 |
| 4,719,748 | 1/1988 | Davis, Jr. et al. | 60/39.37 |

FOREIGN PATENT DOCUMENTS

| | | | |
|---|---|---|---|
| 582479 | 9/1958 | Italy | 60/760 |
| 182034 | 10/1983 | Japan | 60/757 |

*Primary Examiner*—Donald E. Stout
*Attorney, Agent, or Firm*—K. Bach

[57] ABSTRACT

In a gas turbine the transition duct is subject to high temperature since it conducts the combustion products to the power turbine. It is normally cooled by air from the compressor. This invention improves the uniformity of cooling by forcing the cooling air to pass over all surfaces of the transition duct. Air flow passages are formed between the ducts and saddle shaped members which direct the flow of air from the compressor over the outer surfaces of the ducts.

3 Claims, 3 Drawing Sheets

GAS TURBINE COMBUSTOR TRANSITION DUCT FORCED CONVECTION COOLING

This application is a continuation of application Ser. No. 117,980, filed 11/9/87, now abandoned.

FIELD OF THE INVENTION

This invention relates to gas turbines and in particular, to means for reducing the temperature of the surface of transition ducts within such gas turbines.

DESCRIPTION OF THE PRIOR ART

In a typical gas turbine engine air discharged from the compressor enters a combustor shell where the air passed around transition ducts before flowing into the combustor baskets. In the combustor baskets, the air is mixed with fuel and burnt at high temperatures. The combustion gases at high temperatures and pressure then flow from the baskets down the transition ducts to enter the turbine where they are expanded to produce work. In applications where the mean combustion gas temperature exceeds 2000° F. the transition ducts, made from conventional high temperature alloys, begin to show regions of deterioration on the upper surface after short periods of service. The lower and side surfaces of the transition ducts are usually adequately cooled to eliminate this problem but the upper surfaces are not so cooled because of the normal flow of the gas from the compressor.

In the past, efforts have been made to reduce the temperature of the upper surface of the transition ducts by providing a plurality of small cooling holes in the upper surface. In this arrangement, the air from the compressor is permitted to flow into the transition duct and produce a film of cooling air along the upper surface. However, this air has the effect of distorting the combustor gas temperature profile and reducing the efficiency of the turbine.

SUMMARY OF THE INVENTION

In accordance with the present invention, the air from the compressor is forced to flow around the upper surface of the transition duct by means of saddles which partially surround the transition duct and for, between their surface and the surface of the transition duct, an airflow passage. Depending upon the volume and velocity head of the air flowing from the compressor, the saddle member may merely surround a portion of the transition ducts or may be attached to a seal wall which further constrains the flow of compressor air to ensure that it flows completely over the upper surface of the transition ducts. The saddles may be mounted by means of studs on the surface of the transition ducts and these studs may in turn improve the heat exchange.

BRIEF DESCRIPTION OF THE DRAWINGS

A clearer understanding of my invention may be had from a consideration of the drawings in which.

Figure 1:
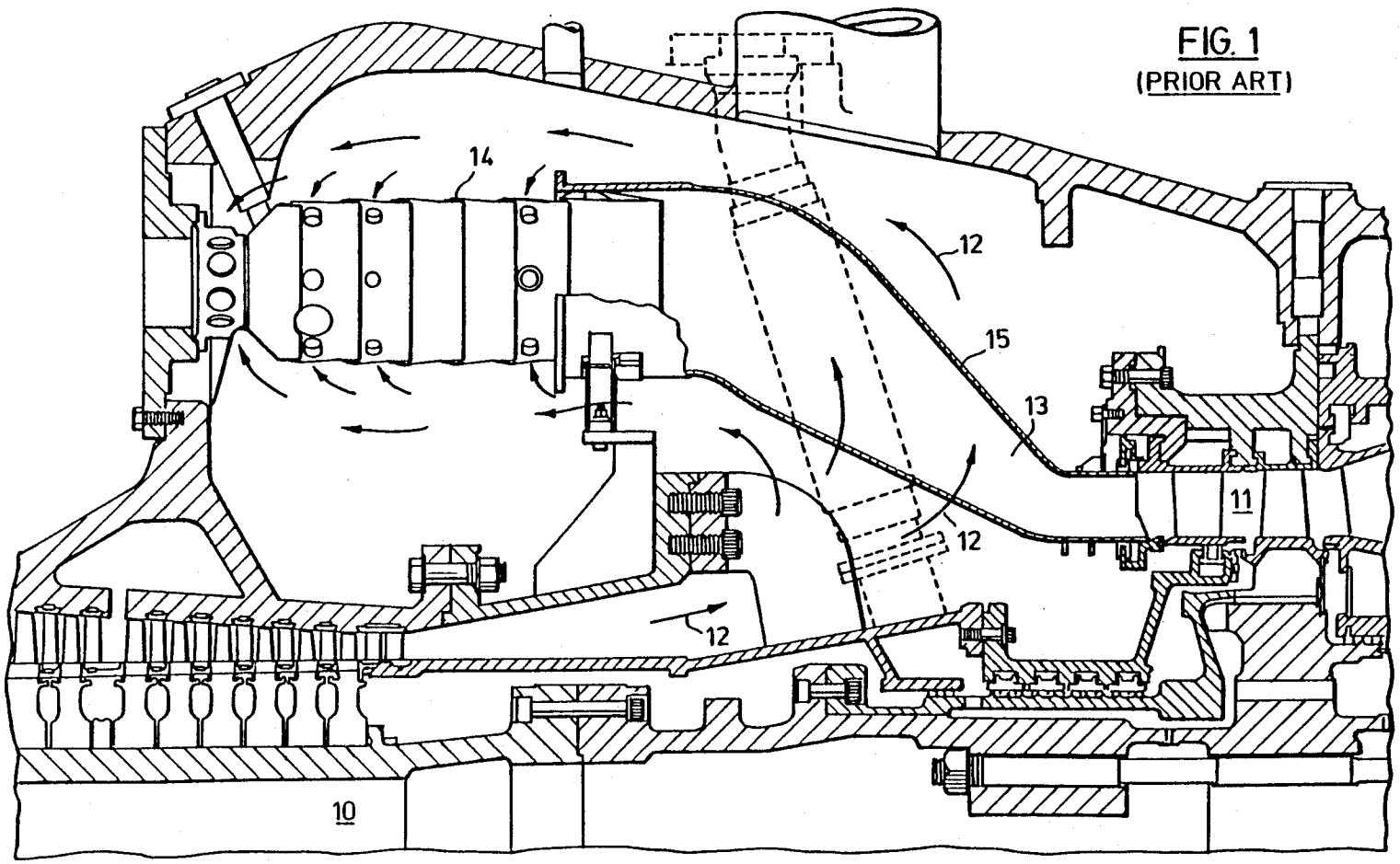
FIG. 1 (PRIOR ART)
FIG. 1 is a view, partially in section, of a portion of a gas turbine of the prior art, showing the normal airflow from the compressor discharge into the combustor basket.

Considering first FIG. 1, the prior art structure, it will be seen that the gas turbine illustrated comprises a compressor section 10 and a power section 11. The compressed air from the compressor section 10 flows in the direction indicated in arrows 12 from the output end of the compressor, past the transition ducts 13, back over the combustor basket 14 and in through the various perforations in the basket, where it mixes with the fuel and is burned. The output of the combustor, is transmitted through the transition duct to the power section 11.

As will be understood, the turbine includes a number of combustors and transition ducts, the latter being arranged in a circle around the central portion of the turbine. The airflow, in passing the transition ducts, therefore first encounters the lower surface of the transition duct and then passes between the ducts and up over the outer surface or directly back from the lower surface, to the combustor. It will be seen that only a small portion of the airflow would normally pass over the upper surface 15 of the transition duct. It will be evident therefore that the temperature of this portion of the transition duct will be higher than that of the other surfaces, such as the lower surface or the side surface which are exposed to greater flows of air.

As has been previously indicated, in order to reduce the temperature of the upper surface 15 of the transition duct, it has been proposed in the past to provide the plurality of perforations through this portion of the surface and thereby permit the air to flow into the transition duct at this area and produce a cooling surface flow of air. As has been indicated, this has deleterious effect.

DESCRIPTION OF THE PREFERRED EMBODIMENT

Figure 2:
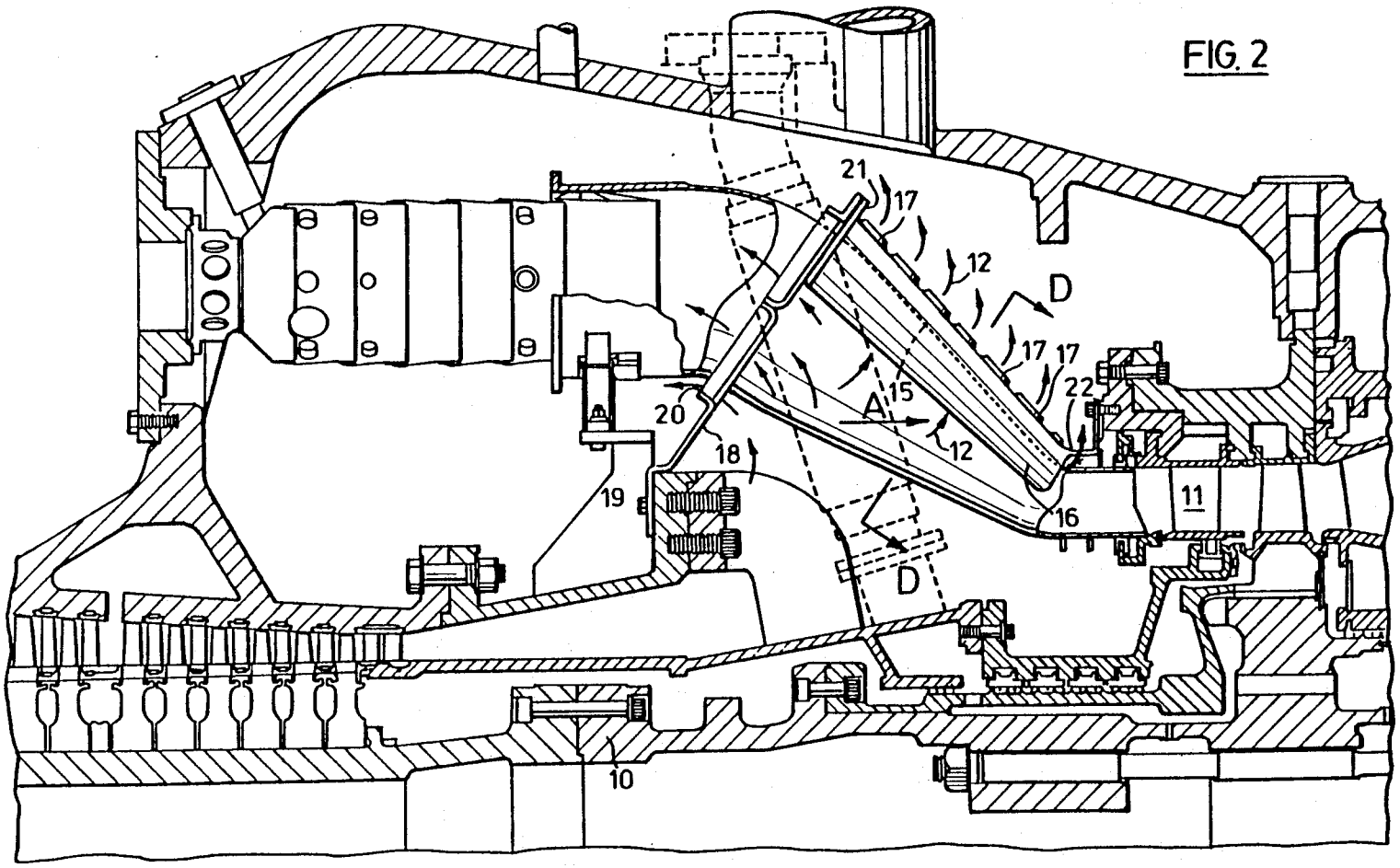
FIG. 2 is a view, partially in section, of a similar gas turbine incorporation the invention.

Turning now to FIG. 2, it will be seen that as before the gas turbine includes a compressor section 10 and a power section 11 and the air from the compressor flows toward the transition ducts. However, in accordance with the invention, there is provided a plurality of saddles 16 surrounding the upper portion of the transition ducts and forming, between the saddle 16 and the upper surface 15 of the transition duct, an air passage through which a portion of the airflow is constrained to pass before proceeding to the combustor.

Figure 3:
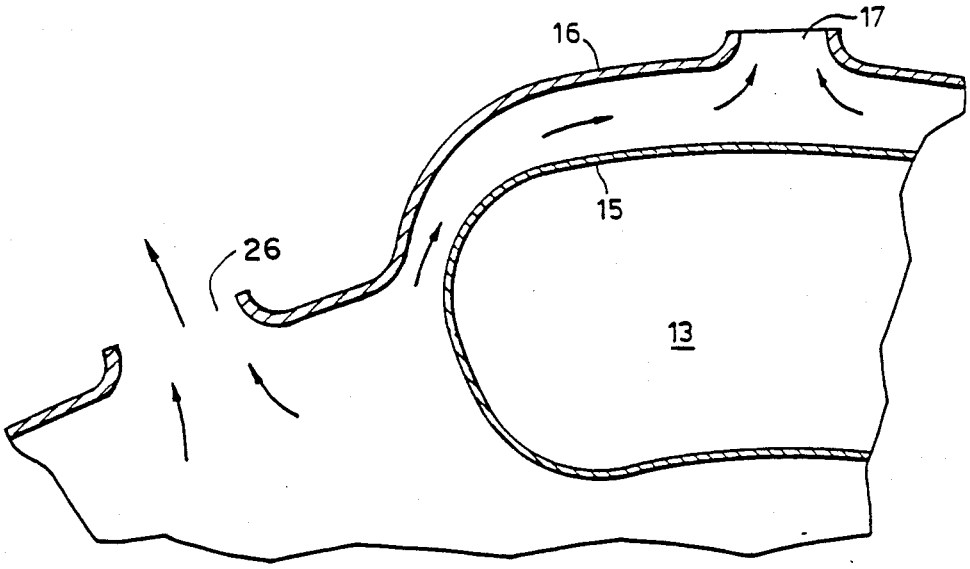
FIG. 3 is a section of a portion of the transition duct and the associated saddle member along the section line DD in FIG. 2.

As shown in greater detail in FIG. 3, a portion of the air passes between the transition duct upper surface 15 and the saddle 16, thus ensuring that the air flows over the upper surface of the transition duct and thereby cools it. Each transition duct has associated with it a saddle 16, and saddle being shaped to conform generally to the contours of the transition duct and including a plurality of perforations near its center line, designated 17 and an extended edge portion which extends outward towards the next adjacent saddle member and forms therebetween a smooth gap 26 through which a portion of the air may flow as seen more clearly in FIG. 3.

To constrain the air to flow under the saddles and around over the upper surface of the transition duct a seal wall is provided in the form of a conical member 18, fastened at its inner edge 19, to the housing of the compressor 10 and having apertures through which the various transition ducts pass, such as aperture 20. It will be seen that this aperture is slightly larger than the diameter of the transition duct and thereby permits some-flow of air around the transition duct through the seal wall through the gap between the seal wall and the transition duct.

The saddle 16 is fastened at its upper edge 21 to the seal wall 18 by welding or bolts and at its lower edge 22 by bolts, to the housing of the power section 11. No effort is made to constrain the total flow to pass around under the saddles and across the upper surface of the transition ducts. The spaces between the saddles and the spaces between the seal wall and the transition duct permit a parallel bypass flow. The formation of these bypass flows and also the ducted flow, out through the orifices 17, is maintained as smooth as possible to reduce turbulence since turbulence would result in greater losses in the operation of the turbine and therefore a less efficient turbine.

Figure 4:
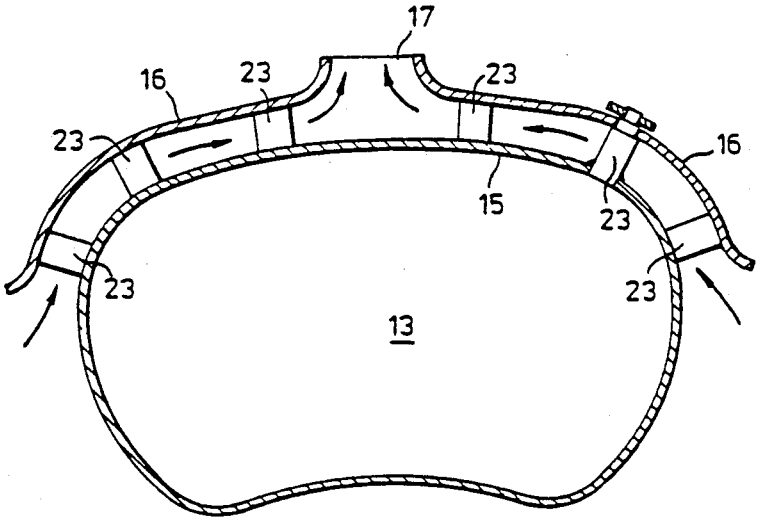
FIG. 4 is a section similar to FIG. 3 showing an alternate structure.

As previously indicated, depending upon the velocity head of the compressor discharge air, it may not be necessary to use a seal wall. In such case the saddles are simply mounted on the transition duct, as shown in FIG. 4, by means of support studs 23 welded to the surface of the transition duct and fastened at their outer end to the saddle. The air passing between adjacent transition ducts encounters the edge of the saddles and a portion is scooped up and caused to flow between the saddle and the surface of the transition duct, associated with that particular saddle. The studs 23 perform two duties. Not only do they support the saddle piece, they also provide a heat transfer surface, somewhat akin to a tube type heat exchanger, transmitting the heat from the surface of the transition duct to the air which passes around the studs.

It is evident that not only may a number of such studs be used to enhance the heat transfer, thus permit the cooling of the transition duct with minimal disturbance of the airflow but also further means, such as ribs, can be provided on the saddle piece or between the saddle piece and the transition duct to improve the heat exchange between the transition duct and the air flowing past it. Such arrangements obviously will reduce the interference and loss of pressure in the airflow which might be produced by other structures, while at the same time permitting the transition duct to be used at higher temperatures without degradation of the material of the duct.

While the invention has been described in its preferred forms it will be evident that other structures and devices may be used to force a portion of the compressor airflow to pass over substantially all surfaces of the transition ducts and thus ensure a more uniform surface temperature of the ducts.

I claim:

1. In a gas turbine including a compressor for producing an air flow, a plurality of radially arranged combustors for producing hot combustion gases supplied with air from said compressor, a power turbine, transition ducts coupling said hot combustion gases from said combustors to said power turbine; means to equalize the surface temperature of said transition ducts comprising saddle shaped members overlying a substantial portion of the radially outward surfaces of said transition ducts to direct the said air flow from said compressor to said combustors substantially uniformly over said outward surfaces of said transition ducts, a seal wall through which said transition ducts pass, said seal wall separating the compressor output from said combustors and forcing all of said airflow from the compressor to flow through apertures in said wall in its path to said combustors.

2. In a gas turbine as claimed in claim 1 a saddle shaped member spaced from the upper surface of said transition duct and mounted at its one end on said seal wall and at its other end on the frame of said power turbine.

3. A gas turbine including a compressor to provide air flow to a plurality of combustors arranged radially around said compressor which provide combustion gases to a power turbine axially aligned with the coupled to said compressor, a plurality of transition ducts coupling said combustion gases from said combustors to said power turbine, means to equalize the temperature of the surfaces of said transition ducts comprising; saddle shaped members spaced radially outwards from said transition ducts and overlying a substantial portion of said transition ducts and forming between said ducts and said saddle shaped members, air ducts and means to cause a substantial portion of the airflow from said compressor to said combustors to flow through said air ducts, including a wall separating the output end of the compressor from said combustors, apertures in said wall through which said transition ducts pass, said saddle shaped members being supported at one end by said wall and said apertures being sufficiently large as to permit nonturbulent flow of air from said compressor around said transition ducts and through the gaps between the transition ducts and the wall to the combustors.

* * * * *